US008822120B2

(12) United States Patent
Abe et al.

(10) Patent No.: US 8,822,120 B2
(45) Date of Patent: Sep. 2, 2014

(54) TONER

(75) Inventors: Nobuhisa Abe, Susono (JP); Shinya Yachi, Mishima (JP); Kazumi Yoshizaki, Suntou-gun (JP); Kenichi Nakayama, Numazu (JP); Shiro Kuroki, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/822,266

(22) PCT Filed: Sep. 28, 2011

(86) PCT No.: PCT/JP2011/072906

§ 371 (c)(1),
(2), (4) Date: Mar. 11, 2013

(87) PCT Pub. No.: WO2012/046747

PCT Pub. Date: Apr. 12, 2012

(65) Prior Publication Data

US 2013/0164666 A1 Jun. 27, 2013

(30) Foreign Application Priority Data

Oct. 4, 2010 (JP) ..... 2010-224636

(51) Int. Cl.
*G03G 9/08* (2006.01)
*G03G 9/087* (2006.01)

(52) U.S. Cl.
CPC ..... *G03G 9/08782* (2013.01)
USPC ..... 430/108.8

(58) Field of Classification Search
CPC ..... G03G 9/08782
USPC ..... 430/108.8
See application file for complete search history.

(56) References Cited

U.S. PATENT DOCUMENTS

| | | | |
|---|---|---|---|
| 5,679,490 | A | 10/1997 | Yachi et al. |
| 5,747,209 | A | 5/1998 | Takiguchi et al. |
| 5,773,185 | A | 6/1998 | Yachi et al. |
| 5,795,694 | A | 8/1998 | Uchiyama et al. |
| 5,856,055 | A | 1/1999 | Ugai et al. |
| 5,863,697 | A | 1/1999 | Uchiyama et al. |
| 5,948,582 | A | 9/1999 | Nakamura et al. |
| 5,994,019 | A | 11/1999 | Okado et al. |

(Continued)

FOREIGN PATENT DOCUMENTS

| | | | |
|---|---|---|---|
| JP | 2000-227674 | A | 8/2000 |
| JP | 2003-195566 | A | 7/2003 |

(Continued)

OTHER PUBLICATIONS

PCT International Search Report and Written Opinion of the International Searching Authority, International Application No. PCT/JP2011/072906, Mailing Date Dec. 20, 2011.

*Primary Examiner* — Mark A Chapman
(74) *Attorney, Agent, or Firm* — Fitzpatrick, Cella, Harper and Scinto

(57) ABSTRACT

To provide a toner having a superior developing performance while preventing any fixing assembly from being contaminated, the toner has toner particles which have toner base particles containing at least a binder resin, a colorant and a wax, and an inorganic fine powder, wherein the wax has a 0.2% by mass heating loss temperature of 200° C. or more and a 1.0% by mass heating loss temperature of 250° C. or more and has a melt viscosity at 120° C. of from 3.0 mPa·s to 15.0 mPa·s.

4 Claims, 1 Drawing Sheet

(56) References Cited

U.S. PATENT DOCUMENTS

| | | | |
|---|---|---|---|
| 6,077,635 | A | 6/2000 | Okado et al. |
| 6,077,636 | A | 6/2000 | Moriki et al. |
| 6,124,067 | A | 9/2000 | Mikuriya et al. |
| 6,137,977 | A | 10/2000 | Okado et al. |
| 6,183,927 | B1 | 2/2001 | Magome et al. |
| 6,187,495 | B1 | 2/2001 | Chiba et al. |
| 6,312,862 | B1 | 11/2001 | Okado et al. |
| 6,316,157 | B1 | 11/2001 | Yoshikawa et al. |
| 6,346,356 | B1 | 2/2002 | Ohno et al. |
| 6,372,400 | B1 | 4/2002 | Yoshizaki et al. |
| 6,506,531 | B1 | 1/2003 | Hakata et al. |
| 6,569,589 | B2 | 5/2003 | Inaba et al. |
| 6,756,170 | B2 | 6/2004 | Nakanishi et al. |
| 6,936,394 | B2 | 8/2005 | Okado et al. |
| 7,014,969 | B2 | 3/2006 | Yachi et al. |
| 7,112,393 | B2 | 9/2006 | Komoto et al. |
| 7,153,625 | B2 | 12/2006 | Kaburagi et al. |
| 7,241,546 | B2 | 7/2007 | Moriki et al. |
| 7,387,860 | B2 | 6/2008 | Moriki et al. |
| 7,459,253 | B2 | 12/2008 | Abe et al. |
| 7,704,661 | B2 | 4/2010 | Ikeda et al. |
| 7,740,999 | B2 | 6/2010 | Inaba et al. |
| 7,745,088 | B2 | 6/2010 | Yoshizaki et al. |
| 7,846,631 | B2 | 12/2010 | Katsuta et al. |
| 8,053,156 | B2 | 11/2011 | Abe et al. |
| 8,084,178 | B2 | 12/2011 | Tosaka et al. |
| 8,247,147 | B2 | 8/2012 | Abe et al. |
| 8,367,292 | B2 | 2/2013 | Kusahara et al. |
| 2012/0328979 | A1 | 12/2012 | Yoshizaki et al. |
| 2013/0177845 | A1 | 7/2013 | Kamikura et al. |

FOREIGN PATENT DOCUMENTS

| | | | |
|---|---|---|---|
| JP | 2009-31736 | A | 2/2009 |
| JP | 2009-217053 | A | 9/2009 |
| JP | 2010-91775 | A | 4/2010 |
| JP | 2010-91787 | A | 4/2010 |
| JP | 2010-139574 | A | 6/2010 |
| JP | 2010-191229 | A | 9/2010 |
| JP | 2010-197979 | A | 9/2010 |

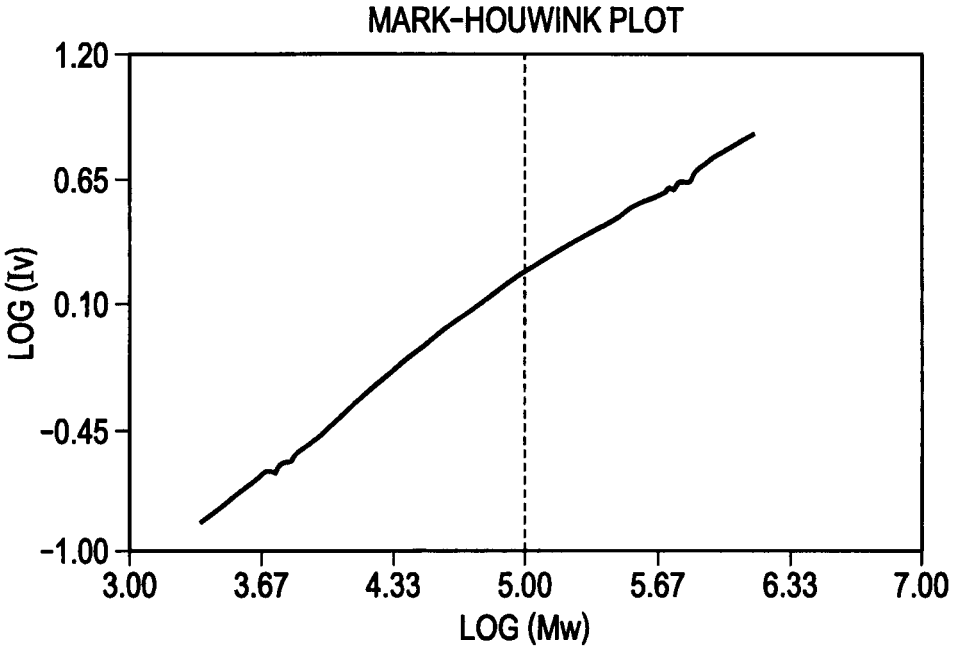
MARK-HOUWINK PLOT
1.20
0.65
0.10
-0.45
-1.00
LOG (Iv)
3.00
3.67
4.33
5.00
5.67
6.33
7.00
LOG (Mw)

TONER

TECHNICAL FIELD

This invention relates to a toner used in recording processes such as electrophotography, electrostatic recording, magnetic recording and toner jet recording.

BACKGROUND ART

Conventionally, in electrophotography, images are obtained by forming an electrostatic latent image on a photosensitive member by utilizing a photoconductive material and by various means, subsequently developing the electrostatic latent image into a toner image by using a toner, and then transferring the toner image to a transfer material such as paper, followed by fixing by the action of heat, pressure, heat-and-pressure, or solvent vapor.

Usually, in toners used in image formation, a release agent is contained as an additive for achieving an improvement in fixing performance. However, where such a toner containing the release agent is used in an image forming process having a fixing step, the toner comes under conditions where it is exposed to high temperature, and hence any readily volatile component such as a low-molecular weight component contained in the release agent volatilizes to cause a problem that a fixing assembly is contaminated.

Accordingly, a toner is proposed in which the heating loss (volatile loss on heating) of the release agent has been specified (see PTL 1). However, toners used in recent years are often put to fixing at a temperature of 200° C. or less, where the toners by no means come under conditions where they are exposed to a high temperature of 300° C. or more.

Accordingly, a toner is proposed in which the heating loss of the release agent at 200° C. has been specified and further, in order to improve the release properties of the toner, the melt viscosity of the release agent has been controlled (see PTL 2). Studies made by the present inventors, however, have revealed that, in order to satisfy development stability at the time of high-speed printing, there is room for further improvement.

CITATION LIST

Patent Literature

PTL 1: Japanese Patent Application Laid-open No. 2000-227674

PTL 2: Japanese Patent Application Laid-open No. 2003-195566

SUMMARY OF INVENTION

Technical Problem

A subject the present invention aims to settle is to provide a toner having a superior developing performance while preventing any fixing assembly from being contaminated.

Solution to Problem

To achieve such an object, the invention according to the present application is a toner comprising toner particles which comprise toner base particles containing at least a binder resin, a colorant and a wax, and an inorganic fine powder; the wax having a 0.2% by mass heating loss temperature of 200° C. or more and a 1.0% by mass heating loss temperature of 250° C. or more, and having a melt viscosity at 120° C. of from 3.0 mPa·s to 15.0 mPa·s.

Advantageous Effects of Invention

According to the present invention, a toner can be obtained which has a superior developing performance while preventing any fixing assembly from being contaminated.

BRIEF DESCRIPTION OF DRAWING

FIGURE is a graph in which the common logarithm of weight-average molecular weight (Mw) as absolute molecular weight, log(Mw), is plotted as abscissa and the common logarithm of viscosity (Iv), log(Iv), is plotted as ordinate, which is measured by GPC-MALLS-viscometer analysis at 135° C.

DESCRIPTION OF EMBODIMENTS

The present inventors have made extensive studies on a toner that can remedy the above problem. In particular, they made many studies on the wax to be contained in the toner. As the result, they have discovered that the controlling of heating loss (volatile loss on heating) and melt viscosity of the wax can very effectively bring out the above advantageous effect, and have accomplished the present invention.

In the present invention, the wax must have, in its thermogravimetric analysis (TGA), a 0.2% by mass heating loss temperature of 200° C. or more. Here, the "0.2% by mass heating loss temperature" of the wax refers to the temperature at a point of time where, when the wax is heated to volatilize or sublimate, the cumulative amount of the wax having volatilized or sublimated has come to 0.2% by mass based on the mass of the wax before heating. The "1.0% by mass heating loss temperature" of the wax as will be referred to later also means alike. Usually, the toner is put to fixing at 200° C. or less, where, since the wax used as a release agent of the toner has a low melting point, any low-molecular weight component contained in the wax may volatilize or sublimate to contaminate a fixing assembly. Hence, the fixing assembly can be kept from being contaminated because of the low-molecular weight component contained in any wax that may otherwise have volatilized or sublimated at the time of fixing if the wax has a 0.2% by mass heating loss temperature of more than 200° C.

In the thermogravimetric analysis (TGA) of the wax, any component that loses its weight at 200° C. to 300° C. is considered to be a component having 20 to 40 carbon atoms. If such a component is contained in a large quantity in the toner, it makes the toner have a low charging stability to come to cause faulty images such as fog. Hence, in the present invention, the wax must have a 1.0% by mass heating loss temperature of 250° C. or more. As long as the heating loss at 250° C. is less than 1.0% by mass, such a component that volatilizes or sublimates at 200° C. to 300° C. is considered to be in a sufficiently small content. Further, in order to promise a good charging stability even during printing on a large number of sheets, the wax may preferably have a 1.0% by mass heating loss temperature of 260° C. or more, and particularly preferably 270° C. or more.

The wax usable in the toner of the present invention may include the following: Petroleum waxes such as paraffin wax, microcrystalline wax and petrolatum, and derivatives thereof; montan wax and derivatives thereof; hydrocarbon waxes obtained by Fischer-Tropsch synthesis, and derivatives thereof; polyolefin waxes such as polyethylene wax and polypropylene wax, and derivatives thereof; and naturally occurring waxes such as carnauba wax and candelilla wax, and derivatives thereof; and ester wax, ketone wax and hardened caster oil, and derivatives thereof, vegetable waxes, animal waxes and silicone wax. Any of these waxes may be used alone or in combination of two or more types.

In the present invention, the wax must have a melt viscosity at 120° C. of from 3.0 mPa·s to 15.0 mPa·s. If its melt viscosity is less than 3.0 mPa·s, the toner may have a low strength to make toner particles tend to break in a developing assembly, and hence tends to cause difficulties such as development lines. If its melt viscosity is more than 15.0 mPa·s, the wax may have a low compatibility with the binder resin, and hence the wax may come low dispersible in toner particles to contaminate members in the developing assembly to tend to cause difficulties such as development lines. The wax may much preferably have a melt viscosity at 120° C. of from 5.0 mPa·s to 10.0 mPa·s.

Such a wax that satisfies the heating loss as specified in the present invention and at the same time has the melt viscosity at 120° C. within the stated range can be achieved by, e.g., blending a plurality of waxes in which a component(s) on the low-molecular weight side has/have been reduced.

The wax may preferably be in a content of from 3.0 parts by mass to 20.0 parts by mass, and much preferably from 6.0 parts by mass to 15.0 parts by mass, based on 100 parts by mass of the binder resin.

In the toner of the present invention, it is preferable that its orthodichlorobenzene (ODCB)-soluble matter extracted at 135° C. has a specific molecular weight distribution and a specific branching degree distribution of molecular chains.

In GPC-MALLS (gel permeation chromatography right angle laser light scattering)-viscometer analysis having made extraction at 135° C., a molecular weight that is not based on molecular size can be determined, a molecular weight of resin component that is closer to the actual condition (this molecular weight is called an absolute molecular weight) can be measured, and branching information of high polymer molecules contained in the resin component can also be obtained. Then, where extraction is operated on the toner at a high temperature (135° C.) by using orthodichlorobenzene (ODCB), gel components that are to be present as ODCB-insoluble matter at normal temperature are also partly come eluted as ODCB-soluble matter. Hence, a molecular weight distribution can be known which is close to a molecular weight distribution of the whole toner particles inclusive of part of the gel components as well.

The temperature 135° C. also is close to the target fixing temperature, and hence the structure and entanglement condition of molecular chains of the resin component at the time of actual fixing can directly be grasped.

The ODCB-soluble matter contained in the toner of the present invention may preferably have a weight-average molecular weight (Mw) of from $2.0\times10^4$ to $1.4\times10^5$ as absolute molecular weight. That the toner has weight-average molecular weight (Mw) within this range is that the toner has relatively low molecular weight as composition of its resin component. In this case, the resin component has relatively low viscosity at the time of fixing, and hence images are improved in glossiness.

In the GPC-MALLS-viscometer analysis, distribution information of a straight-chain polymer and that of a branched polymer are also obtainable. In general, high polymer molecules increase in viscosity with an increase in molecular weight because of an influence of bulkiness of their structure. Also, where the viscosities of any high polymer molecules are compared which are high polymer molecules having the same molecular weights but having different degrees of branching, the extent of molecules is more restrained with an increase in the degree of branching and the radius of rotation also becomes smaller, and hence the viscosity thereof decreases. Such a relationship, when the common logarithm of viscosity (Iv), log(Iv), is plotted with respect to the common logarithm of absolute molecular weight (M), log(M), is known to show a linear straight-line relationship that is peculiar to constituent monomers. Also, the gradient of this straight-line becomes smaller because, the more the high polymer molecules contain components having a high degree of branching in their molecular distribution, the lower viscosity they show as compared with those in molecular distribution of high polymer molecules composed of only straight chains.

When the common logarithm of absolute molecular weight (M), log(M), is plotted as abscissa and the common logarithm of viscosity (Iv), log(Iv), is plotted as ordinate (shown in FIG. 1) and where the whole gradient is represented by a and the gradient in a region where the common logarithm of absolute molecular weight (M), log(M), is 5.00 or more is represented by b, the toner of the present invention may preferably have a value of b/a of from 0.30 to 0.95. That the value of b/a is from 0.30 to 0.95 means that the toner has a high degree of branching in the high-molecular weight side. In this case, the toner is improved in hot-offset resistance and low-temperature fixing performance, and can have a broad temperature range where it is fixable.

To control the molecular weight and degree of branching of the resin component constituting the toner of the present invention and regulate the value of b/a, available are a method in which a plurality in type of resin components the molecular weight and degree of branching of which have previously been controlled are blended optionally with use of a compatibilizer, and a method in which, where monomers are polymerized by a polymerization process to produce toner particles directly, an initiator having a high hydrogen abstraction effect is selected and the way of addition and conditions for activation are regulated so as to control cross-linking reaction and graft polymerization to control the degree of branching. It may also be controlled by selecting types of monomers and adding a cross-linking agent.

As a further preferable form of the present invention, the toner particles may preferably have a carboxyl group-containing styrene resin having a weight-average molecular weight (Mw) of from 10,000 to 30,000 as measured by gel permeation chromatography of tetrahydrofuran (THF)-soluble matter. The presence of such a carboxyl group-containing styrene resin in the toner particles makes the toner particles have a flexibility to improve fixing stability and transfer performance.

The carboxyl group-containing styrene resin usable in the present invention may include styrene copolymers synthesized by using acrylic acid or methacrylic acid as a copolymer component at least. It may further preferably include styrene copolymers having an acid value and a hydroxyl value.

In the present invention, the carboxyl group-containing styrene resin may be in a content of from 5 parts by mass to 30 parts by mass based on 100 parts by mass of the binder resin.

How to produce the toner of the present invention is described below.

The toner particles (herein refer to "toner base particles" when applicable as toner particles standing before any external additive is added thereto) used in the present invention may be produced by using whatever method, and may preferably be produced by a production process in which granulation is carried out in an aqueous medium, such as suspension polymerization, emulsion polymerization or suspension granulation. Where toner particles are produced by any commonly available pulverization process, it involves a very high degree of technical difficulty to incorporate the wax component in a large quantity in toner particles. The production process in which the toner base particles are obtained by granulation in an aqueous medium enables enclosure of the wax component in the particles without making it present on the surfaces of toner particles even when the wax component is added to the toner particles in a large quantity. Hence, in the fixing step, the toner can be prevented as far as possible from offsetting to a fixing member to contaminate a heating source.

Of these production processes, the suspension polymerization is the best because the wax component can be enclosed in the toner particles to provide them with capsule structure, and is suited to dramatically improve resistance to, e.g., filming to a developing roller and improve storage stability.

How to produce the toner particles is described below, taking the case of the suspension polymerization as an example, which is preferable in order to obtain the toner particles used in the present invention.

A polymerizable monomer(s) for binder resin, the colorant, the wax and optionally other additives are uniformly dissolved or dispersed by means of a dispersion machine such as a homogenizer, a ball mill, a colloid mill or an ultrasonic dispersion machine, and a polymerization initiator is dissolved in the resultant mixture to prepare a polymerizable monomer composition. Next, this polymerizable monomer composition is suspended in an aqueous medium containing a dispersion stabilizer, to effect polymerization, whereby the toner particles are produced.

The polymerization initiator may be added at the same time when other additives are added to the polymerizable monomer(s), or may be mixed immediately before the polymerizable monomer composition is suspended in the aqueous medium. A polymerization initiator having been dissolved in the polymerizable monomer or in a solvent may also be added immediately after granulation or before the polymerization reaction is started.

As the binder resin used in the toner of the present invention, vinyl copolymers composed of a styrene resin or acrylic resin, polyester resins and the like may be used. A case making use of a vinyl copolymer, which is especially advantageous for reproducibility of branched structure and for developing performance, is preferable because the toner is more improved in development stability.

Among such vinyl resins (vinyl copolymers), a styrene-acrylic resin obtained by copolymerizing styrene and an acrylic monomer (inclusive of a methacrylic monomer) is preferable because the branched structure as in the present invention can precisely be controlled with ease.

The polymerizable monomer for forming the binder resin may include the following: Styrene; styrene monomers such as o-, m- or p-methylstyrene, and m- or p-ethylstyrene; and acrylic or methacrylic ester monomers such as methyl acrylate, methyl methacrylate, ethyl acrylate, methyl methacrylate, propyl acrylate, propyl methacrylate, butyl acrylate, butyl methacrylate, octyl acrylate, octyl methacrylate, dodecyl acrylate, dodecyl methacrylate, stearyl acrylate, stearyl methacrylate, behenyl acrylate, behenyl methacrylate, 2-ethylhexyl acrylate, 2-ethylhexyl methacrylate, dimethylaminoethyl acrylate, dimethylaminoethyl methacrylate, diethylaminoethyl acrylate and diethylaminoethyl methacrylate.

In producing the toner of the present invention, as a means for controlling the molecular weight and degree of branching of the binder resin component, it is preferable to use a cross-linking agent when the binder resin is synthesized.

The cross-linking agent used in the present invention may include, as a bifunctional cross-linking agent, the following: Divinylbenzene, bis(4-acryloxypolyethoxyphenyl)propane, ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, diethylene glycol diacrylate, triethylene glycol diacrylate, tetraethylene glycol diacrylate, polyethylene glycol #200 diacrylate, polyethylene glycol #400 diacrylate, polyethylene glycol #600 diacrylate, dipropylene glycol diacrylate, polypropylene glycol diacrylate, polyester type diacrylates (MANDA; available from Nippon Kayaku Co., Ltd.), and the above diacrylates each acrylate moiety of which has been replaced with methacrylate.

As a polyfunctional cross-linking agent, it may include the following: Pentaerythritol triacrylate, trimethylolethane triacrylate, trimethylolpropane triacrylate, tetramethylolmethane tetraacrylate, oligoester acrylate, and methacrylates of these, and also 2,2-bis(4-methacryloxy-polyethoxyphenyl)propane, diallyl phthalate, triallyl cyanurate, triallyl isocyanurate and triallyl trimellitate.

Any of these cross-linking agents may preferably be added in an amount of from 0.01 part by mass or more to 10 parts by mass or less, and much preferably from 0.1 part by mass or more to 5 parts by mass or less, based on 100 parts by mass of the polymerizable monomer(s).

As the polymerization initiator usable in order to control the molecular weight and degree of branching of the binder resin, an oil-soluble initiator and/or a water-soluble initiator may be used. It may preferably be one having a half-life of from 0.5 hour or more to 30 hours or less at reaction temperature at the time of polymerization reaction. It may also be used in its addition in an amount of from 0.5 part by mass or more to 20 parts by mass or less, based on 100 parts by mass of the polymerizable monomer.

As the polymerization initiator, it may be exemplified by azo or diazo type polymerization initiators such as 2,2'-azobis-(2,4-dimethylvaleronitrile), 2,2'-azobisisobutyronitrile, 1,1'-azobis-(cyclohexane-1-carbonitrile), 2,2'-azobis-4-methoxy-2,4-dimethylvaleronitrile and azobisisobutyronitrile; and peroxide type polymerization initiators such as benzoyl peroxide, t-butyl peroxy-2-ethylhexanoate, t-butyl peroxypivarate, t-butyl peroxyisobutyrate, t-butyl peroxyneodecanoate, methyl ethyl ketone peroxide, diisopropyl peroxycarbonate, cumene hydroperoxide, 2,4-dichlorobenzoyl peroxide and lauroyl peroxide.

In order to control the degree of branching of the binder resin within a preferable range, the initiator having a high hydrogen abstraction effect may be made present from the initial stage of polymerization reaction, and a method is available in which the polymerization is effected in a highly reactive atmosphere. As the initiator having a high hydrogen abstraction ability, an organic peroxide type initiator is preferable, and it is most preferable to use a PERBUTYL type organic peroxide capable of forming t-butoxy radicals. Also, the highly reactive atmosphere refers to, e.g., an atmosphere that is higher by at least 10° C. than the 10-hour half-life temperature of the initiator.

In the present invention, any known chain transfer agent, polymerization inhibitor and so forth may further be added so as to be used in order to control the degree of polymerization of the polymerizable monomer constituting the binder resin.

In the toner of the present invention, a charge control agent it may optionally be used as being mixed into the toner particles. Such incorporation with a charge control agent enables stabilization of charge characteristics and control of optimum triboelectric charge quantity in conformity with the development system.

As the charge control agent, any known charge control agent may be used. In particular, charge control agents which can give speedy charging and also can maintain a constant charge quantity stably are preferred. Further, where the toner particles are directly produced by polymerization, it is particularly preferable to use charge control agents having a low polymerization inhibitory action and being substantially free of any solubilizate to the aqueous medium.

As the charge control agent, and as a charge control agent capable of controlling the toner to be negatively chargeable, an organic metal complex or a chelate compound is preferred. It may include, e.g., monoazo metal compounds, acetylacetone metal compounds, aromatic hydroxycarboxylic acids, aromatic dicarboxylic acids, and metal compounds of hydroxycarboxylic acid or dicarboxylic acid. Besides, it may also include aromatic hydroxycarboxylic acids, aromatic mono- and polycarboxylic acids, and metal salts, anhydrides or esters thereof, as well as phenolic derivatives such as bisphenol. They may further include urea derivatives, metal-containing salicylic acid compounds, metal-containing naphthoic acid compounds, boron compounds, quaternary ammonium salts, carixarene, and resin type charge control agents.

As a charge control agent capable of controlling the toner to be positively chargeable, it may include the following: Nigrosine and Nigrosine-modified products, modified with a fatty acid metal salt or the like; guanidine compounds; imidazole compounds; quaternary ammonium salts such as tributylbenzylammonium 1-hydroxy-4-naphthosulfonate and tetrabutylammonium teterafluoroborate, and analogues of these, including onium salts such as phosphonium salts, and lake pigments of these; triphenylmethane dyes and lake pigments of these (lake-forming agents may include tungstophosphoric acid, molybdophosphoric acid, tungstomolybdophosphoric acid, tannic acid, lauric acid, gallic acid, ferricyanides and ferrocyanides); metal salts of higher fatty acids; and resin type charge control agents.

The toner of the present invention may contain any of these charge control agents alone or in combination of two or more types.

The charge control agents may preferably be mixed in an amount of from 0.1 part by mass or more to 20.0 parts by mass or less, and much preferably from 0.5 part by mass or more to 10.0 parts by mass or less, based on 100 parts by mass of the binder resin. However, the addition of the charge control agent is not essential for the toner of the present invention. The triboelectric charging between the toner and a toner layer thickness control member and developer carrying member may actively be utilized, and this makes it not always necessary for the toner to be incorporated with the charge control agent.

The toner of the present invention contains the colorant as an essential component in order to afford coloring power. As the colorant preferably be used in the present invention, it may include the following organic pigments, organic dyes and inorganic pigments.

Organic pigments or organic dyes as cyan colorants may include copper phthalocyanine compounds and derivatives thereof, anthraquinone compounds and basic dye lake compounds. Stated specifically, they may include C.I. Pigment Blue 1, 7, 15, 15:1, 15:2, 15:3, 15:4, 60, 62 and 66.

Organic pigments or organic dyes as magenta colorants may include the following: Condensation azo compounds, diketopyrrolopyrrole compounds, anthraquinone compounds, quinacridone compounds, basic dye lake compounds, naphthol compounds, benzimidazolone compounds, thioindigo compounds and perylene compounds. Stated specifically, they may include the following: C.I. Pigment Red 2, 3, 5, 6, 7, 48:2, 48:3, 48:4, 57:1, 81:1, 122, 144, 146, 150, 166, 169, 177, 184, 185, 202, 206, 220, 221, 254 and 282; and C.I. Pigment Violet 19 and 23.

Organic pigments or organic dyes as yellow colorants may include compounds typified by condensation azo compounds, isoindolinone compounds, anthraquinone compounds, azo metal complexes, methine compounds and allylamide compounds. Stated specifically, they may include the following: C.I. Pigment Yellow 12, 13, 14, 15, 17, 62, 74, 83, 93, 94, 95, 97, 109, 110, 111, 120, 127, 128, 129, 147, 151, 154, 155, 168, 174, 175, 176, 180, 181, 191 and 194.

As black colorants, they may include carbon black and colorants toned in black by the use of yellow, magenta and cyan colorants shown above, or magnetic materials.

Any of these colorants may be used alone, in the form of a mixture, or in the state of a solid solution. The colorants used in the present invention are selected taking account of hue angle, chroma, brightness, light-fastness, transparency on OHP films and dispersibility in toner particles.

In the case of a colorant other than the magnetic materials, it may preferably be used in its addition in an amount of from 1 part by mass or more to 20 parts by mass or less, based on 100 parts by mass of the binder resin. In the when a magnetic material is used as the colorant, it may preferably be used in its addition in an amount of from 30 parts by mass or more to 200 parts by mass or less, based on 100 parts by mass of the binder resin.

When the toner particles used in the present invention are granulated in the aqueous medium, any of known inorganic and organic dispersion stabilizers may be used as the dispersion stabilizer used in preparing the aqueous medium. In particular, an inorganic sparingly water-soluble dispersion stabilizer is preferred, and yet it is preferable to use a sparingly water-soluble dispersion stabilizer that is soluble in acid.

Stated specifically, the inorganic dispersion stabilizer may include as examples thereof the following: Tricalcium phosphate, magnesium phosphate, aluminum phosphate, zinc phosphate, magnesium carbonate, calcium carbonate, calcium hydroxide, magnesium hydroxide, aluminum hydroxide, calcium metasilicate, calcium sulfate, barium sulfate, bentonite, silica and alumina. Also, the organic dispersion stabilizer may include the following: Polyvinyl alcohol, gelatin, methyl cellulose, methyl hydroxypropyl cellulose, ethyl cellulose, carboxymethyl cellulose sodium salt, and starch.

Commercially available nonionic, anionic or cationic surface active agents may also be used. Such a surface active agent may include the following: Sodium dodecyl sulfate, sodium tetradecyl sulfate, sodium pentadecyl sulfate, sodium octyl sulfate, sodium oleate, sodium laurate, potassium stearate and calcium oleate.

Where the aqueous medium in which the dispersion stabilizer as described above has been dispersed is prepared, it may be dispersed using a commercially available dispersion stabilizer as it is. Also, in order to obtain particles of the dispersion stabilizer which have a fine and uniform particle size, the inorganic dispersion stabilizer may be formed in a liquid medium such as water under high-speed agitation to prepare the aqueous medium. For example, where tricalcium phosphate is used as the dispersion stabilizer, an aqueous sodium phosphate solution and an aqueous calcium chloride solution may be mixed under high-speed agitation to form fine particles of the tricalcium phosphate, whereby a preferable dispersant can be obtained.

The toner of the present invention may preferably be a toner comprising toner particles which comprise the toner base particles and an external additive such as an inorganic fine powder.

The inorganic fine powder may include inorganic fine powders such as fine silica powder, fine titanium oxide powder and fine aluminum oxide powder, or double oxides of any of these. Of these inorganic fine powders, fine silica powder and fine titanium oxide powder are preferred. Also, as an external additive other than the inorganic fine powder, it may include resin particles of various types and fatty acid metal salts. Any of these may be used alone or in combination of two or more.

The fine silica powder may include dry-process silica or fumed silica produced by vapor phase oxidation of a silicon halide, wet-process silica produced from water glass, and sol-gel silica produced by a sol-gel process. As the inorganic fine powder, the dry-process silica is preferred, as having less silanol groups on the particle surfaces and interiors of the fine silica powder and leaving less production residues such as $Na_2O$ and $SO_3^{2-}$. The dry-process silica may also be a composite fine powder of silica with other metal oxide, produced by, in its production step, using a metal halide such as aluminum chloride or titanium chloride together with the silicon halide.

Subjecting the inorganic fine powder to hydrophobic treatment enables the toner to be regulated for its charge quantity, improved in environmental stability and improved in properties in a high-temperature and high-humidity environment, and hence it is preferable to use an inorganic fine powder having been subjected to hydrophobic treatment. If the inorganic fine powder added externally to the toner particles (toner base particles) absorbs moisture, the toner lowers in its charge quantity to tend to cause a lowering of developing performance and transfer performance, showing a tendency to lower in running performance.

As a hydrophobic-treating agent for the inorganic fine powder, it may include unmodified silicone varnish, modified silicone varnish of various types, unmodified silicone oil, modified silicone oil of various types, silane compounds, silane coupling agents, other organosilicon compounds, and organotitanium compounds. Any of these treating agents may be used alone or in combination.

In particular, inorganic fine powders having been treated with silicone oil are preferred. Much preferably, hydrophobic-treated inorganic fine powders obtained by subjecting the inorganic fine powder to hydrophobic treatment with a coupling agent and, simultaneously with or after the treatment, treatment with silicone oil are preferred as having superior environmental properties.

Various measuring methods according to the present invention are described below.

Thermogravimetric Analysis

The thermogravimetric analysis of the wax is made by using a thermogravimetric instrument TA-TGA2950 (manufactured by TA Instruments Japan Ltd.), where a pan holding a sample therein is retained at 40° C. for 1 minute and thereafter heated at a heating rate of 10° C./min up to 600° C. in an atmosphere of oxygen.

Melt Viscosity

The melt viscosity of the wax is measured with an E-type rotational viscometer. VT-500 (manufactured by HAAKE Co.) is used as the viscometer. In Examples, it is measured at a temperature having been set to 120° C. by means of an oil bath fitted with a temperature regulator, using a PK1-0.5° cone in a sensor, and measured at a shear rate of 6,000 $s^{-1}$.

GPC-MALLS-Viscometer Analysis

1. Pretreatment 0.1 g of the toner is put into a filtration container for exclusive use (e.g., a dissolution filtration container manufactured by Tosoh Corporation; pore size: 10 μm), and then put into a 15 ml test tube together with 10 ml of ODCB. This is dissolved at 135° C. for 24 hours, using a solution filter (e.g., DF-8020, manufactured by Tosoh Corporation). After 24 hours, analysis is made using the following instruments.

2. Analytical Conditions

Instruments: HLC-8121GPC/HT (manufactured by Tosoh Corporation); DAWN EOS (manufactured by Wyatt Technology Corporation); and a high-temperature differential pressure viscosity detector (manufactured by Viscotek Corporation).

Columns: Combination of three columns, 30.0 cm(L) TSKgel GMHHR-H (30) HT 7.8 cm(ID)×30.0 cm(L) TSKgel GMHHR-H (20) HT 7.8 cm(ID)×30.0 cm(L) TSKgel GMHHR-H HT 7.8 cm(ID) (available from Tosoh Corporation).

Detector 1: Multiple-angle light scattering detector, Wyatt DAWN EOS.

Detector 2: High-temperature differential pressure viscosity detector.

Detector 3: Blaise type dual flow differential diffractometer.

Temperature: 135° C.

Solvent: o-Dichlorobenzene (0.05% dibutylhydroxytoluene added).

Flow rate: 1.0 ml/min.

Injected: In an amount of 400 μl.

Where the above instruments are used, the molecular weight distribution and viscosity on the basis of absolute molecular weight are directly outputted. In processing the data, ASTRA for Windows 4.73.04 (available from Wyatt Technology Corporation) is used. When the analysis is made, 0.068 ml/g which is a value in a styrene-acrylic resin is used as the value of do/dc.

The weight-average molecular weight as absolute molecular weight and the gradients a and b formed when the common logarithm of viscosity (Iv), log(Iv), that represents the degree of branching is plotted with respect to the common logarithm of absolute molecular weight (M), log(M), in the present invention are found by executing Mark-Houwink-Sakurada Plots, using software for exclusive use "TriSEC GPC Software GPC-LS-Viscometry Module, Version 3.0, Rev. B.05.15" (available from Viscotek Corporation) attached to the instrument.

In calculating the absolute molecular weight, it is determined by using a standard polystyrene resin (e.g., trade name: TSK Standard Polystyrene F-10), and making calibration from known molecular weight and viscosity (e.g., weight-average molecular weight (Mw) of 96,400 and intrinsic viscosity of 0.411 dl/g when the above F-10 is used).

Incidentally, the whole resin component (A) of the toner in the present invention is the whole resin component of a chromatogram a viscometer has detected in a three-dimensional simultaneous-output profile of the GPC-MALLS-viscometer analysis at 135° C. Also, a component (B) on the high-molecular weight side in the whole resin component (A) of the toner in the present invention is a resin component the value of the common logarithm of weight-average molecular weight (Mw) as absolute molecular weight, log(Mw), of which is 5.00 or more in that analysis. Further, the ratio of the degree of branching of the component (B) on the high-molecular weight side to the degree of branching of the whole resin component (A) is the value found by calculating the ratio b/a of the gradients of the respective components as defined above.

Measurement of Molecular Weight of Carboxyl Group-Containing Styrene resin:

The weight-average molecular weight of the carboxyl group-containing styrene resin is measured in the following way by gel permeation chromatography (GPC).

First, the resin is dissolved in tetrahydrofuran (THF) at room temperature over a period of 24 hours. Then, the solution obtained is filtered with a solvent-resistant membrane filter "MAISHORIDISK" (available from Tosoh Corporation) of 0.2 μm in pore diameter to make up a sample solution. Here, the sample solution is so controlled that the component soluble in THF is in a concentration of about 0.5% by mass. Using this sample solution, the measurement is made under the following conditions.

Instrument: HLC8120 GPC (detector: R1) (manufactured by Tosoh Corporation).

Columns: Combination of seven columns, Shodex KF-801, KF-802, KF-803, KF-804, KF-805, KF-806 and KF-807 (available from Showa Denko K.K.).

Eluent: Tetrahydrofuran (THF).

Flow rate: 1.0 ml/min.

Oven temperature: 40.0° C.

Amount of sample injected: 0.10 ml.

To calculate the molecular weight (main-peak molecular weight) of the sample for measurement, a molecular weight calibration curve is used which is prepared using a standard polystyrene resin (e.g., trade name "TSK Standard Polystyrene F-850, F-450, F-288, F-128, F-80, F-40, F-20, F-10, F-4, F-2, F-1, A-5000, A-2500, A-1000, A-500"; available from Tosoh Corporation).

EXAMPLES

The present invention is described below in greater detail by giving working examples shown below, which, however, by no means limit the present invention. In the following working examples and comparative examples, "part(s)" and "%" are by mass in all occurrences unless particularly noted.

Preparation Example of Wax 1

2.0 parts of HNP-9 (available from Nippon Seiro Co., Ltd.) and 8.0 parts of FNP-9 (available from Nippon Seiro Co., Ltd.) were mixed, and the mixture obtained was heated under conditions of reduced pressure to thereby remove low-molecular weight components to prepare a wax 1. Physical properties of the wax 1 are shown in Table 1.

Preparation Example of Wax 2

2.0 parts of HNP-0090 (available from Nippon Seiro Co., Ltd.) and 8.0 parts of FT105 (available from Nippon Seiro Co., Ltd.) were mixed, and the mixture obtained was heated under conditions of reduced pressure to thereby remove low-molecular weight components to prepare a wax 2. Physical properties of the wax 2 are shown in Table 1.

Preparation Example of Wax 3

6.0 parts of HNP-9 (available from Nippon Seiro Co., Ltd.) and 4.0 parts of HNP-0090 (available from Nippon Seiro Co., Ltd.) were mixed, and the mixture obtained was heated under conditions of reduced pressure to thereby remove low-molecular weight components to prepare a wax 3. Physical properties of the wax 3 are shown in Table 1.

Preparation Example of Wax 4

6.0 parts of HNP-10 (available from Nippon Seiro Co., Ltd.) and 4.0 parts of HNP-0090 (available from Nippon Seiro Co., Ltd.) were mixed, and the mixture obtained was heated under conditions of reduced pressure to thereby remove low-molecular weight components to prepare a wax 4. Physical properties of the wax 4 are shown in Table 1.

Preparation Example of Wax 5

8.0 parts of HNP-10 (available from Nippon Seiro Co., Ltd.) and 2.0 parts of FT105 (available from Nippon Seiro Co., Ltd.) were mixed, and the mixture obtained was heated under conditions of reduced pressure to thereby remove low-molecular weight components to prepare a wax 5. Physical properties of the wax 5 are shown in Table 1.

Preparation Example of Wax 6

2.0 parts of HNP-9 (available from Nippon Seiro Co., Ltd.) and 8.0 parts of HNP-11 (available from Nippon Seiro Co., Ltd.) were mixed, and the mixture obtained was heated under conditions of reduced pressure to thereby remove low-molecular weight components to prepare a wax 6. Physical properties of the wax 6 are shown in Table 1.

Preparation Example of Wax 7

3.0 parts of FT105 (available from Nippon Seiro Co., Ltd.) and 7.0 parts of FT115 (available from Nippon Seiro Co., Ltd.) were mixed, and the mixture obtained was heated under conditions of reduced pressure to thereby remove low-molecular weight components to prepare a wax 7. Physical properties of the wax 7 are shown in Table 1.

Preparation Example of Wax 8

2.0 parts of HNP-11 (available from Nippon Seiro Co., Ltd.) and 8.0 parts of FT115 (available from Nippon Seiro Co., Ltd.) were mixed, and the mixture obtained was heated under conditions of reduced pressure to thereby remove low-molecular weight components to prepare a wax 8. Physical properties of the wax 8 are shown in Table 1.

Preparation Example of Wax 9

7.0 parts of HNP-5 (available from Nippon Seiro Co., Ltd.) and 3.0 parts of FT105 (available from Nippon Seiro Co., Ltd.) were mixed, and the mixture obtained was heated under conditions of reduced pressure to thereby remove low-molecular weight components to prepare a wax 9. Physical properties of the wax 9 are shown in Table 1.

Preparation Example of Wax 10

5.0 parts of HNP-11 (available from Nippon Seiro Co., Ltd.) and 5.0 parts of SP-1035 (available from Nippon Seiro Co., Ltd.) were mixed, and the mixture obtained was heated under conditions of reduced pressure to thereby remove low-molecular weight components to prepare a wax 10. Physical properties of the wax 10 are shown in Table 1.

Preparation Example of Wax 11

2.0 parts of HNP-10 (available from Nippon Seiro Co., Ltd.) and 8.0 parts of FT115 (available from Nippon Seiro Co., Ltd.) were mixed, and the mixture obtained was heated under conditions of reduced pressure to thereby remove low-molecular weight components to prepare a wax 11. Physical properties of the wax 11 are shown in Table 1.

Preparation Example of Wax 12

1.0 parts of HNP-5 (available from Nippon Seiro Co., Ltd.), 2.0 parts of HNP-10 (available from Nippon Seiro Co., Ltd.) and 7.0 parts of FT115 (available from Nippon Seiro Co., Ltd.) were mixed, and the mixture obtained was heated under conditions of reduced pressure to thereby remove low-molecular weight components to prepare a wax 12. Physical properties of the wax 12 are shown in Table 1.

Preparation Example of Wax 13

8.0 parts of HNP-5 (available from Nippon Seiro Co., Ltd.) and 2.0 parts of FT115 (available from Nippon Seiro Co., Ltd.) were mixed, and the mixture obtained was heated under conditions of reduced pressure to thereby remove low-molecular weight components to prepare a wax 13. Physical properties of the wax 13 are shown in Table 1.

TABLE 1

| | 0.2% by mass heating loss temperature (° C.) | 1.0% by mass heating loss temperature (° C.) | 120° C. Melt viscosity (Pa · s) |
|---|---|---|---|
| Wax 1 | 265 | 290 | 6.0 |
| Wax 2 | 255 | 270 | 10.0 |
| Wax 3 | 250 | 270 | 5.0 |
| Wax 4 | 240 | 260 | 5.0 |
| Wax 5 | 230 | 250 | 5.0 |
| Wax 6 | 230 | 250 | 3.0 |
| Wax 7 | 255 | 270 | 15.0 |
| Wax 8 | 235 | 250 | 15.0 |
| Wax 9 | 200 | 250 | 5.0 |
| Wax 10 | 230 | 250 | 2.5 |
| Wax 11 | 235 | 250 | 17.0 |
| Wax 12 | 230 | 245 | 15.0 |
| Wax 13 | 195 | 250 | 5.0 |

Preparation Example of Carboxyl Group-Containing Styrene Resin 1

| | |
|---|---|
| Styrene (St) | 1.65 parts |
| Methyl methacrylate (MMA) | 2.50 parts |
| Methacrylic acid (MAA) | 3.35 parts |
| 2-Hydroxylethyl methacrylate (2HEMA) | 2.50 parts |
| PERBUTYL D (trade name; 10-hour half-life temperature: 54.6° C.; available from NOF Corporation) | 2.00 parts |

In a four-necked flask, with stirring of 200 parts of xylene, the inside atmosphere of the container was sufficiently displaced with nitrogen and was heated to 140° C., and thereafter the above components were dropwise added thereto over a period of 2 hours. Further, with retention for 10 hours under reflux of xylene, polymerization was completed, and the solvent was evaporated off under reduced pressure. The carboxyl group-containing styrene resin 1 thus obtained had a weight-average molecular weight (Mw) of 14,500, a glass transition temperature (Tg) of 92° C., an acid value (Av) of 20.3 mgKOH/g and a hydroxyl value (OHv) of 10.0 mgKOH/g.

Preparation Examples of Carboxyl Group-Containing Styrene Resins 2 & 3

Carboxyl group-containing styrene resins 2 and 3 were produced in the same way as in Preparation Example of Carboxyl Group-containing Styrene Resin 1 except that, in Preparation Example of Carboxyl Group-containing Styrene Resin 1, the amount of PERBUTYL D added was changed. The carboxyl group-containing styrene resin 2 thus obtained had a weight-average molecular weight (Mw) of 30,000, a glass transition temperature (Tg) of 92° C., an acid value (Av) of 20.3 and a hydroxyl value (OHv) of 10.0 mgKOH/g. The carboxyl group-containing styrene resin 3 had a weight-average molecular weight (Mw) of 10,000, a glass transition temperature (Tg) of 92° C., an acid value (Av) of 20.3 and a hydroxyl value (OHv) of 10.0 mgKOH/g.

Production Example of Polyester Resin

| | |
|---|---|
| Terephthalic acid | 15.00 parts |
| Isophthalic acid | 15.00 parts |
| Bisphenol-A propylene oxide 2-mole addition product | 70.00 parts |
| Potassium oxalate titanate | 0.03 part |

Into an autoclave having a vacuum device, a water separator, a nitrogen gas feeder, a thermometer and a stirrer, the above components were fed, and reaction was carried out at 220° C. for 17 hours in an atmosphere of nitrogen, and the reaction was further carried out for 0.5 hour under reduced pressure of 10 to 20 mmHg. Thereafter, the temperature was dropped to 180° C., and then 0.10 part of trimellitic anhydride was added, where the reaction was carried out at 175° C. for 2.0 hours to obtain a polyester resin. The polyester resin thus obtained had a weight-average molecular weight (Mw) of 9,500, a glass transition temperature (Tg) of 73° C. and an acid value (Av) of 8.0 mgKOH/g.

Production Example of Toner 1

To 1,300 parts of ion-exchanged water heated to 60° C., 9.0 parts of tricalcium phosphate was added, and these were stirred at 10,000 rpm by means of a TK-type homomixer (manufactured by Tokushu Kika Kogyo Co., Ltd.), followed by addition of hydrochloric acid to obtain an aqueous medium with a pH of 5.2.

In a separate container, the following materials were also dissolved by means of a propeller type stirrer to prepare a resin solution.

| | |
|---|---|
| Styrene | 70.00 parts |
| n-Butyl acrylate | 30.00 parts |
| C.I. Pigment Blue 15:3 | 7.00 parts |
| Carboxyl group-containing styrene resin 1 | 10.00 parts |
| Above Polyester Resin | 5.00 parts |
| Charge control agent (BONTRON E-88, available from Orient Chemical Industries, Ltd.) | 1.00 part |
| Wax 1 | 9.00 parts |
| Divinylbenzene | 0.25 part |

Next, the resin solution was introduced into the above aqueous medium, and these were stirred at a temperature of 60° C. in an atmosphere of nitrogen and at 10,000 rpm by means of the TK type homomixer. Subsequently, to the mixture obtained, 2.00 parts of PERBUTYL NHP (trade name;

10-hour half-life temperature: 50.6° C.; available from NOF Corporation) and 8.00 parts of PERBUTYL PV (trade name; 10-hour half-life temperature: 54.6° C.; available from NOF Corporation) were added, and these were stirred for 30 hours to effect granulation. Thereafter, with stirring by using a paddle stirring blade, the temperature was raised to 70.0° C. The reaction was carried out for 5 hours, and thereafter the temperature was further raised to 80.0° C., where the reaction was carried out for 3 hours. After the reaction system was cooled, hydrochloric acid was added to adjust its pH to 1.4, and these were stirred for 3 hours. The toner particles formed were separated by filtration and then washed with water, followed by drying at a temperature of 40° C. for 48 hours to obtain toner particles 1. The toner particles 1 obtained had a weight-average particle diameter (D4) of 6.0 μm.

To 100.0 parts the toner particles 1 (toner base particles), 1.5 parts of hydrophobic fine silica powder (number-average primary particle diameter: 16 nm) having been surface-treated with dimethylsilicone oil was externally added by dry-process mixing for 10 minutes by means of Henschel mixer (manufactured by Mitsui Mining Co. Ltd.) to obtain a toner 1. Physical properties of the toner 1 are shown in Table 3.

Production Examples of Toners 2 to 10, 12 to 20 & 22 to 25

Points changed from those in Production Example of Toner 1 are shown in Table 2. Toners 2 to 10, 12 to 20 and 22 to 25 were produced in the same way as in Preparation Example of Toner 1 except for what were changed as shown in Table 2. Physical properties of the toners obtained are shown in Table 3.

Production Example of Toner 11

The toner particles (toner base particles) standing before the hydrophobic fine silica powder was externally added in Production Example of Toner 10 were melt-kneaded by using a twin-screw extruder heated to 110° C. The kneaded product obtained and cooled was crushed by means of a hammer mill, and the crushed product was finely pulverized by means of an impact type jet mill (manufactured by Nippon Pneumatic MFG. Co., Ltd.). The finely pulverized product obtained was air-classified to obtain toner particles 11. The toner particles 11 had a weight-average particle diameter (D4) of 6.0 μm.

To 100.0 parts the toner particles 11 (toner base particles), 1.5 parts of hydrophobic fine silica powder (number-average primary particle diameter: 16 nm) having been surface-treated with dimethylsilicone oil was externally added by dry-process mixing for 10 minutes by means of Henschel mixer (manufactured by Mitsui Mining Co. Ltd.) to obtain a toner 11. Physical properties of the toner 11 are shown in Table 3.

Production Example of Toner 21

A toner 21 was produced in the same way as in Preparation Example of Toner 11 except that, in Preparation Example of Toner 11, the toner particles to be melt-kneaded were changed for the toner particles (toner base particles) standing before the hydrophobic fine silica powder was externally added in Production Example of Toner 20. Physical properties of the toner 21 are shown in Table 3.

TABLE 2

| Toner | Divinylbenzene Amt. | Carboxyl group-containing styrene resin Type | Wax Type | Polymerization initiator PERBUTYL NHP Amt. | Polymerization initiator PERBUTYL PV Amt. | Reaction temp. (° C.) | Remarks |
|---|---|---|---|---|---|---|---|
| 1 | 0.25 | 1 | 1 | 2.00 | 8.00 | 70.0 | |
| 2 | 0.50 | 2 | 2 | 3.50 | 6.50 | 68.0 | |
| 3 | 0.05 | 3 | 3 | 0.20 | 8.00 | 72.0 | |
| 4 | 0.05 | — | 3 | 0.20 | 8.00 | 72.0 | |
| 5 | 0.05 | 3 | 4 | 0.20 | 8.00 | 72.0 | |
| 6 | 0.05 | — | 4 | 0.20 | 8.00 | 72.0 | |
| 7 | 0.05 | — | 5 | 0.20 | 8.00 | 72.0 | |
| 8 | 0.05 | — | 6 | 0.20 | 8.00 | 72.0 | |
| 9 | 0.50 | 2 | 7 | 3.50 | 6.50 | 68.0 | |
| 10 | 0.50 | — | 8 | 3.50 | 6.50 | 68.0 | |
| 11 | 0.50 | — | 8 | 3.50 | 6.50 | 68.0 | *1 |
| 12 | 0.50 | 2 | 2 | 4.10 | 6.00 | 67.5 | |
| 13 | 0.04 | 3 | 3 | 0.10 | 8.00 | 72.0 | |
| 14 | 0.04 | — | 3 | 0.10 | 8.00 | 72.0 | |
| 15 | 0.60 | 2 | 2 | 3.70 | 6.50 | 66.5 | |
| 16 | 0.04 | 3 | 3 | 0.20 | 8.00 | 73.0 | |
| 17 | 0.58 | 2 | 2 | 3.50 | 6.30 | 67.0 | |
| 18 | 0.01 | 3 | 3 | 0.20 | 8.00 | 72.0 | |
| 19 | 0.01 | — | 3 | 0.20 | 8.00 | 72.0 | |
| 20 | 0.01 | — | 9 | 0.20 | 8.00 | 72.0 | |
| 21 | 0.01 | — | 9 | 0.20 | 8.00 | 72.0 | *1 |
| 22 | 0.05 | — | 10 | 0.20 | 8.00 | 72.0 | |
| 23 | 0.50 | — | 11 | 3.50 | 6.50 | 68.0 | |
| 24 | 0.50 | — | 12 | 3.50 | 6.50 | 68.0 | |
| 25 | 0.01 | — | 13 | 0.20 | 8.00 | 72.0 | |

*1 Pulverization after polymerization

TABLE 3

| | GPC-MALLS-viscometer analysis | | | |
|---|---|---|---|---|
| | Weight-average molecular weight (Mw) | Gradient b | Gradient a | b/a |
| Toner 1 | 74,000 | 0.60 | 0.92 | 0.65 |
| Toner 2 | 140,000 | 0.24 | 0.80 | 0.30 |
| Toner 3 | 20,000 | 0.95 | 1.00 | 0.95 |
| Toner 4 | 20,000 | 0.95 | 1.00 | 0.95 |
| Toner 5 | 20,000 | 0.95 | 1.00 | 0.95 |
| Toner 6 | 20,000 | 0.95 | 1.00 | 0.95 |
| Toner 7 | 20,000 | 0.95 | 1.00 | 0.95 |
| Toner 8 | 20,000 | 0.95 | 1.00 | 0.95 |
| Toner 9 | 140,000 | 0.24 | 0.80 | 0.30 |
| Toner 10 | 140,000 | 0.24 | 0.80 | 0.30 |
| Toner 11 | 140,000 | 0.24 | 0.80 | 0.30 |
| Toner 12 | 140,000 | 0.23 | 0.82 | 0.28 |
| Toner 13 | 20,000 | 0.98 | 1.01 | 0.97 |
| Toner 14 | 20,000 | 0.98 | 1.01 | 0.97 |
| Toner 15 | 160,000 | 0.25 | 0.83 | 0.30 |
| Toner 16 | 15,000 | 0.86 | 0.91 | 0.95 |
| Toner 17 | 160,000 | 0.23 | 0.81 | 0.28 |
| Toner 18 | 15,000 | 1.01 | 1.04 | 0.97 |
| Toner 19 | 15,000 | 1.01 | 1.04 | 0.97 |
| Toner 20 | 15,000 | 1.01 | 1.04 | 0.97 |
| Toner 21 | 15,000 | 1.01 | 1.04 | 0.97 |
| Toner 22 | 20,000 | 0.95 | 1.00 | 0.95 |
| Toner 23 | 140,000 | 0.24 | 0.80 | 0.30 |
| Toner 24 | 140,000 | 0.24 | 0.80 | 0.30 |
| Toner 25 | 15,000 | 1.01 | 1.04 | 0.97 |

Example 1

Using the toner 1, evaluation was made as detailed below.

A conversion machine (process speed: 240 mm/sec) of a laser beam printer LBP9500C (manufactured by CANON INC.) was used as an evaluation machine, and its toner cartridge 32211 (cyan) was filled with the toner 1. Glossiness, low-temperature fixing performance, hot-offset resistance and fixing stability were evaluated in a normal-temperature and normal-humidity environment (23° C./55% RH), fixing non-uniformity, fog, development lines and transfer performance were evaluated in a high-temperature and high-humidity environment (30° C./80% RH), and filming to developing roller was evaluated in a low-temperature and low-humidity environment (15° C./10% RH). The evaluation in the high-temperature and high-humidity environment and low-temperature and low-humidity environment each was made after images with a print percentage of 5% were printed on 15,000 sheets in each environment.

Here, A4-size CLC Color Copy Paper (available from CANON INC.; basis weight: 80 g/m$^2$) was used as evaluation paper in evaluation except for that of low-temperature fixing performance. Storage stability at 55° C. was also evaluated. The results of evaluation are shown in Table 4.

(1) Glossiness

The toner laid-on level on evaluation paper was set to 0.50 mg/cm$^2$, and images were reproduced in which a solid colored (cyan) image of 5 cm in length and 20 cm in width was formed at 5 cm from the leading end of the A4-sheet in its lengthwise direction and a solid white image on areas extending rearward therefrom. The glossiness of fixed images at a measurement optical-part angle of 75° was measured with a gloss meter PG-3G (manufactured by Nippon Denshoku Industries Co., Ltd.), and evaluated according to the following criteria.

A: Glossiness is 35 or more.

B: Glossiness is 25 or more to less than 35.

C: Glossiness is 20 or more to less than 25.

D: Glossiness is less than 25.

(2) Low-Temperature Fixing Performance

BUSINESS 4200 (basis weight: 105 g/m$^2$; available from Xerox Corporation) was used as evaluation paper, and solid colored images the toner laid-on level of which was set to 0.50 mg/cm$^2$ were formed, and fixed while changing fixing temperature at intervals of 10° C. within the range of from 130° C. to 200° C. The fixed images obtained were back and forth rubbed five times with soft thin paper (e.g., trade name: DUSPER; available from Ozu Corporation) under application of a load of 4.9 kPa, where the rate (%) of decrease in image density was calculated according to the following expression and the temperature at which the rate of density decrease came to 10% or less was regarded as fixing start temperature, to make evaluation according to the following criteria. Here, the image density was measured with a color reflection densitometer (X-RITE 404A, manufactured by X-Rite, Incorporated).

Rate of density decrease=[(image density before rubbing−image density after rubbing)×100]/image density before rubbing.

A: Fixing start temperature is less than 160° C.

B: Fixing start temperature is 160° C. or more to less than 180° C.

C: Fixing start temperature is 180° C. or more to less than 200° C.

D: Fixing start temperature is 200° C. or more.

(3) Hot-Offset Resistance

A halftone image of 5 cm×5 cm in area was formed in a toner laid-on level of 0.3 mg/cm$^2$, and the temperature of fixing-heated area surface at which an offset phenomenon (a phenomenon that part of fixed images adheres to member surfaces of the fixing assembly and further adheres onto a recording material on the next rotation) occurred at the rear end portion of the evaluation paper in its paper feed direction when it passed through the fixing assembly was measured, which was taken as the temperature at which the phenomenon of high-temperature offset occurred (hot-offset temperature) to make evaluation according to the following criteria.

A: Hot-offset temperature is 220° C. or more.

B: Hot-offset temperature is 210° C. or more to less than 220° C.

C: Hot-offset temperature is 200° C. or more to less than 210° C.

D: Hot-offset temperature is less than 200° C.

(4) Fixing Stability

Solid colored images the toner laid-on level on evaluation paper of which was 0.50 mg/cm$^2$ were formed and reproduced. The fixed images obtained were so folded that the image face was on the outside, and how much the images were damaged or not was visually judged. Judgment criteria are as follows.

A: There comes no damage on the fixed images.

B: Very slight damage is seen along the fold.

C: There comes damage on the fixed images to such an extent that it can clearly visually be seen.

D: The fixed images come seriously broken and come off along the fold.

(5) Fixing Non-Uniformity

Solid colored images the toner laid-on level on evaluation paper of which was 0.50 mg/cm$^2$ were formed and reproduced. The glossiness of fixed images at a measurement optical-part angle of 75° was measured with a gloss meter PG-3G (manufactured by Nippon Denshoku Industries Co., Ltd.), and the difference in glossiness between the maximum value and the minimum value was found to make evaluation on fixing non-uniformity according to the following criteria.

A: The difference in glossiness is less than 2.0%.

B: The difference in glossiness is 2.0% or more to less than 4.0%.

C: The difference in glossiness is 4.0% or more to less than 6.0%.

D: The difference in glossiness is 6.0% or more.

(6) Fog

Images having white background areas were reproduced at the initial stage and after running, and fog density (%) was calculated from the difference between the whiteness of white background areas of reproduced images and the whiteness of a recording material as measured with REFLECTOMETER MODEL TC-6DS (manufactured by Tokyo Denshoku Co., Ltd.) to make evaluation on image fog according to the following criteria. As a filter, an amber filter was used.

A: Fog density is less than 1.0%.

B: Fog density is 1.0% or more to less than 2.0%.

C: Fog density is 2.0% or more to less than 3.0%.

D: Fog density is 3.0% or more.

(7) Development Lines

Halftone images the toner laid-on level of which was 0.3 mg/cm$^2$ were formed, and the surfaces of images and developing roller were visually observed to make evaluation according to the following criteria.

A: Any vertical lines are not seen both on the developing roller and also on the halftone images.

B: One to three fine line(s) is/are seen on the developing roller in its peripheral direction, but any vertical lines are not seen on the halftone images.

C: Several fine lines are seen on the developing roller in its peripheral direction, and several fine lines are seen also on the halftone images.

D: Many conspicuous lines are seen on the developing roller and on the halftone images.

(8) Transfer Performance

Solid colored images the toner laid-on level of which was set to 0.50 mg/cm$^2$ were formed, in the course of which transfer efficiency was found from changes in mass between the toner level on the photosensitive member and the toner level on the evaluation paper to make evaluation according to the following criteria (a case in which the toner on the photosensitive member was completely transferred onto the evaluation paper was regarded as a 100% transfer efficiency).

A: Transfer efficiency is 95% or more.

B: Transfer efficiency is 90% or more to less than 95%.

C: Transfer efficiency is 80% or more to less than 90%.

D: Transfer efficiency is less than 80%.

mostatic chamber, and thereafter the toner was visually observed and touched with fingers to make evaluation according to the following criteria.

A: There is seen no change, showing a very superior storage stability.

B: The toner becomes somewhat low fluid, but shows superior storage stability.

C: Agglomerates come to form, but break with ease.

D: Agglomerates can be held with fingers, and do not break with ease; showing an inferior storage stability.

Examples 2 to 21 & Comparative Examples 1 to 4

The toners 2 to 25 were used to make evaluation in the same way as that in Example 1. The results of evaluation are shown in Table 4.

TABLE 4

| | | Glossiness | Low = temp. fixing performance | Hot = offset resistance | Fixing stability | Fixing non-uniformity | Fog Initial stage | Fog After running | Development lines | Transfer performance | Filming | Storage stability |
|---|---|---|---|---|---|---|---|---|---|---|---|---|
| Example | | | | | | | | | | | | |
| 1 | Toner 1 | A | A | A | A | A | A | A | A | A | A | A |
| 2 | Toner 2 | A | A | A | A | A | A | A | A | A | A | A |
| 3 | Toner 3 | A | A | A | A | A | A | A | A | A | A | A |
| 4 | Toner 4 | A | A | A | B | A | A | A | A | B | A | A |
| 5 | Toner 5 | A | A | A | A | A | A | B | A | A | A | A |
| 6 | Toner 6 | A | A | A | B | A | A | B | A | B | A | A |
| 7 | Toner 7 | A | A | A | B | A | A | C | A | B | A | A |
| 8 | Toner 8 | A | A | A | B | A | A | C | B | B | A | A |
| 9 | Toner 9 | A | A | A | A | A | A | A | B | A | A | A |
| 10 | Toner 10 | A | A | A | B | A | A | C | B | B | A | A |
| 11 | Toner 11 | A | A | A | B | A | A | C | B | B | B | B |
| 12 | Toner 12 | A | A | B | A | A | A | A | A | A | A | A |
| 13 | Toner 13 | A | B | A | A | A | A | A | A | A | A | A |
| 14 | Toner 14 | A | B | A | B | A | A | A | A | B | A | A |
| 15 | Toner 15 | B | A | A | A | A | A | A | A | A | A | A |
| 16 | Toner 16 | B | A | A | A | A | A | A | A | A | A | A |
| 17 | Toner 17 | B | A | B | A | A | A | A | A | A | A | A |
| 18 | Toner 18 | B | B | A | A | A | A | A | A | A | A | A |
| 19 | Toner 19 | B | B | A | B | A | A | A | A | B | A | A |
| 20 | Toner 20 | B | B | A | B | A | A | C | A | B | A | A |
| 21 | Toner 21 | B | B | A | B | A | A | C | A | B | B | B |
| Comparative Example: | | | | | | | | | | | | |
| 1 | Toner 22 | A | A | A | B | A | A | C | D | B | A | A |
| 2 | Toner 23 | A | A | A | B | A | A | C | D | B | A | A |
| 3 | Toner 24 | A | A | A | B | A | D | D | B | B | A | A |
| 4 | Toner 25 | B | B | A | B | D | A | C | A | B | A | A |

(9) Filming to Developing Roller

In halftone images the toner laid-on level of which was 0.3 mg/cm$^2$, whether or not any tone non-uniformity occurred at 5%-print image areas and at non-image areas was visually observed to make evaluation according to the following criteria. Thereafter, the toner on the developing roller surface was blown off, and then the developing roller surface was observed to make evaluation.

A: Any tone non-uniformity does not occur on the images, and also any filming is seen on the developing roller surface.

B: Any tone non-uniformity does not occur on the images, but filming is somewhat seen on the developing roller surface.

C: Slight tone non-uniformity occurs on the images.

D: Ugly tone non-uniformity occurs on the images.

(10) Storage Stability 5 g of the toner was put into a 100 ml polyethylene cup, and this was left to stand for 3 days in a 55° C. (±0.5° C.) ther- While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-224636, filed Oct. 4, 2010, which is hereby incorporated by reference herein in its entirety.

The invention claimed is:

1. A toner comprising toner particles which comprise toner base particles, each of which contains at least a binder resin, a colorant and a wax, and an inorganic fine powder;

the wax having:

i) a 0.2% by mass heating loss temperature of 200° C. or more and a 1.0% by mass heating loss temperature of 250° C. or more; and ii) a melt viscosity at 120° C. of from 3.0 mPa·s to 15.0 mPa·s.

2. The toner according to claim 1, wherein the wax has a 1.0% by mass heating loss temperature of 270° C. or more.

3. The toner according to claim 1, wherein, with regard to absolute molecular weight measured by GPC-MALLS-viscometer analysis at 135° C., orthodichlorobenzene (ODCB)-soluble matter of the toner has a weight-average molecular weight (Mw) of from $2.0\times10^4$ to $1.4\times10^5$.

4. The toner according to claim 3, which, when the common logarithm of absolute molecular weight (M), log(M), is plotted as abscissa and the common logarithm of viscosity (Iv), log(Iv), is plotted as ordinate and where the whole gradient is represented by a and the gradient in a region where the common logarithm of absolute molecular weight (M), log (M), is 5.00 or more is represented by b, has a value of b/a of from 0.30 to 0.95.

* * * * *